US005645902A

United States Patent [19]

Cheng

[11] Patent Number: 5,645,902

[45] Date of Patent: Jul. 8, 1997

[54] DECORATIVE PULL BOW

[76] Inventor: Peter S. C. Cheng, 99 Glencairn Street, Toronto, Ontario,, Canada, M4R 1M7

[21] Appl. No.: 319,380

[22] Filed: Oct. 6, 1994

[51] Int. Cl.[6] ..... D04D 7/10

[52] U.S. Cl. ..... 428/5; 428/16; 223/46

[58] Field of Search ..... 223/44, 46; 428/4, 428/5, 16, 101, 136, 24; 2/244; 28/147

[56] References Cited

U.S. PATENT DOCUMENTS

| | | | |
|---|---|---|---|
| 2,104,248 | 1/1938 | Stark | 223/46 |
| 3,041,765 | 7/1962 | Paar | 223/46 |
| 3,637,455 | 1/1972 | Pearson et al. | 223/46 |
| 3,922,407 | 11/1975 | Nimmo, Jr et al. | 428/5 |
| 4,476,168 | 10/1984 | Aoyama | 428/4 |
| 4,515,837 | 5/1985 | Cheng | 428/4 |
| 4,656,064 | 4/1987 | Cheng | 428/4 |
| 4,900,632 | 2/1990 | McGrath | 223/46 |

*Primary Examiner*—Amy B. Vanatta
*Attorney, Agent, or Firm*—Kirschstein, et al.

[57] ABSTRACT

A decorative element is held in a predetermined orientation on and relative to a bow by surrounding loops formed by pulling a drawstring relative to ribbons. The decorative element customizes the pull bow.

14 Claims, 3 Drawing Sheets

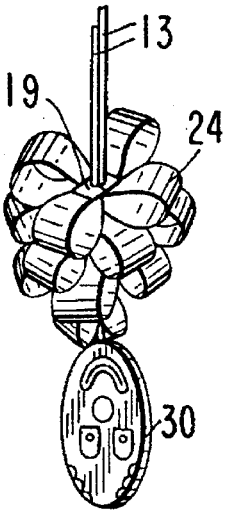
FIG. 5
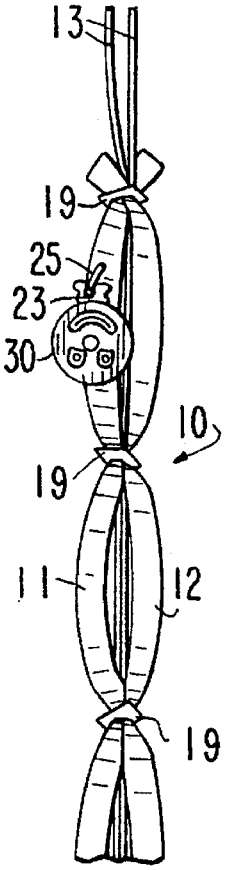
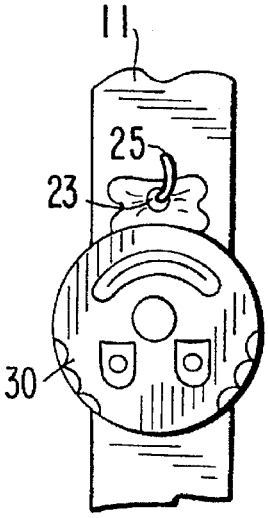
FIG. 9
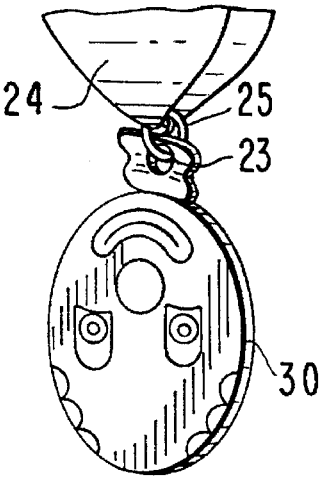
FIG. 6
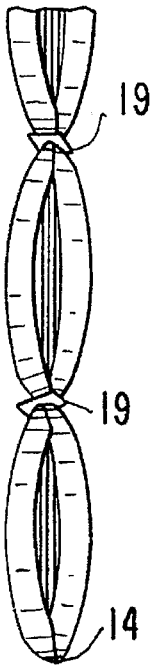
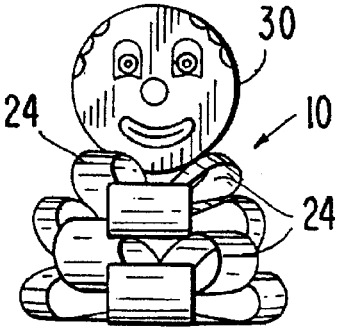
FIG. 7
FIG. 8
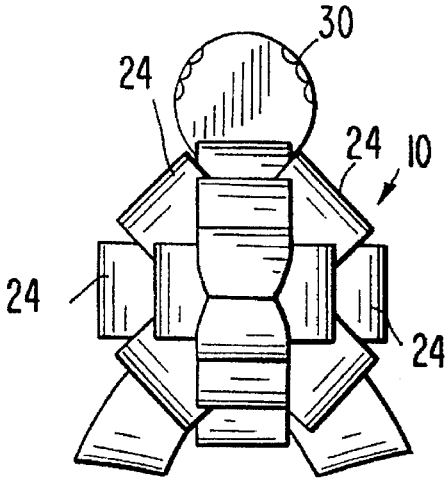
FIG. 10

DECORATIVE PULL BOW

BACKGROUND OF THE INVENTION

1. Field of the Invention

This invention generally relates to a decorative pull bow for attachment to wrapped gifts, and, more particularly, to a bow-forming assembly having multiple loops for holding a decorative element in a predetermined orientation on the bow.

2. Description of the Related Art

Ribbon and drawstring assemblies formable into decorative bows for attachment to wrapped gifts and containers are known. For example, in my U.S. Pat. No. 4,515,837, a single ribbon strip folded over to form two ribbons at a common end, or a pair of ribbons joined at a common end, were each subdivided into bow sections arranged lengthwise along each ribbon. Retainers were provided between each adjacent pair of bow sections. A drawstring was secured to the common end, and was extended between and along the ribbons and loosely through the retainers. By pulling on the drawstring, each bow section was folded to form an arcuate loop. The more loops, the fuller was the bow thus formed. By orienting adjacent retainers at different angles of inclination relative to the longitudinal axis along which each ribbon was elongated, the loops automatically arranged themselves at differing offset angles spaced around a central bow axis to provide a desired rosette or pompom form.

In my U.S. Pat. No. 4,822,648, I proposed a pull bow having a drawstring with a short-travel stroke and slitted sheet-like bow members, each forming a plurality of foldable bow sections. Upon pulling the drawstring, the bow sections were folded to form the desired rosette or pompom configuration.

Although the known pull bows have proven to be quite satisfactory for their intended purpose, some gift givers desire still more ornamentation and distinctiveness for the bow itself. Rather than adorning a wrapped gift with a multi-looped bow which is identical for all occasions, there is a need to provide a customized bow having a decorative element more symbolic of a particular occasion.

SUMMARY OF THE INVENTION

Objects of the Invention

It is a general object of this invention to advance the state of the art of pull An additional object of this invention is to provide a more ornamental, more distinctive, customized pull bow.

An additional object of this invention is to automatically arrange loops of a decorative pull bow in a circular array to form a rosette, and to use at least one of the loops to automatically position a decorative element in a predetermined orientation on the bow.

Yet another object of this invention is to provide a decorative pull bow that is inexpensive to manufacture, that is capable of being packaged in a generally flattened state, and which can be easily formed into a three-dimensional looped bow.

Features of the Invention

In keeping with these objects and others which will become apparent hereinafter, one feature of this invention resides, briefly stated, in a decorative bow assembly having a plurality of foldable bow sections initially arranged in a bow-unformed position. Gathering means, such as a drawstring, is operative for folding the bow sections into loops to form a three-dimensional, looped rosette or pompom configuration in which the loops are automatically angularly arranged in an annulus about a central bow axis to form the bow.

In accordance with this invention, a decorative element is automatically positioned and held in a predetermined orientation by at least one, and preferably a plurality, of the loops upon formation of the bow. The decorative element can be three-dimensional, but is preferably a generally planar, one-dimensional sheet on which graphics is displayed, so that the assembly can be packed and shipped in a generally flat package prior to formation into a bow.

Preferably, the decorative element is designed to portray a desired theme or message. For example, the theme could be the expression of birthday wishes, congratulations, holiday greetings, and myriad other expressions of sentiment commonly found in greeting cards. The decorative element can also display desired messages of the type conventionally exchanged by gift givers. The decorative element and/or the graphics could include any thematic character, real or imaginary, or any alpha-numeric message. The decorative element is preferably held in an upright vertical position at the center of the bow and serves as a centerpiece, but could also be held in a generally horizontal position, or, for that matter, in any other inclined position anywhere on the bow.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a perspective view illustrating a subsequent stage in the procedure of forming the completed bow;

FIG. 6 is a broken-away, perspective view on an enlarged scale showing the attachment of a decorative element to the assembly of FIG. 1;

FIG. 7 is a front-elevational view showing the completed bow with the decorative element held in a predetermined orientation centrally of the completed bow;

FIG. 8 is a view analogous to FIG. 1, but of another embodiment of this invention;

FIG. 9 is a broken-away, front elevational view showing the attachment of the decorative element to the assembly of FIG. 8;

FIG. 10 is a bottom plan view of the completed bow of FIG. 8;

DETAILED DESCRIPTION OF THE PREFERRED EMBODIMENTS

Figure 1:
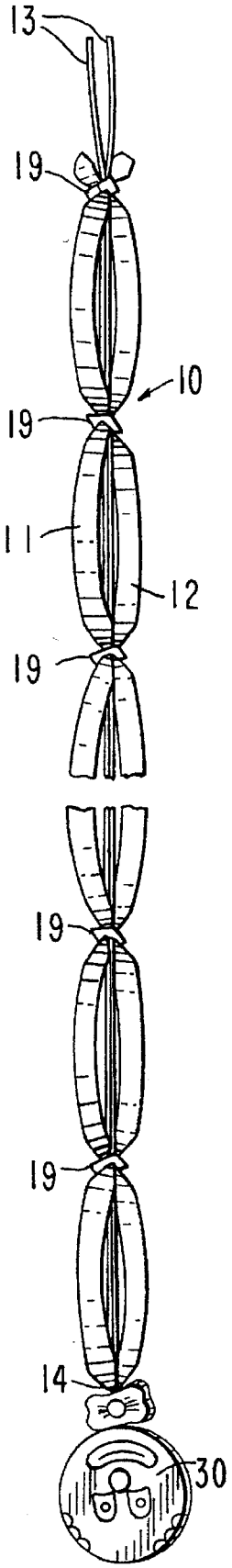
FIG. 1 is a broken-away perspective view of one embodiment of a decorative bow assembly in accordance with this invention prior to formation into a bow.

Referring now to the drawings, FIG. 1 shows a decorative bow-forming assembly 10 having two ribbon members 11, 12 disposed in a face-to--face relationship. Members 11 and 12 are formed by taking a length of conventional decorative ribbon material, e.g., a conventional synthetic plastic having a satin-like, fibrous texture, and folding it at its middle or distal common end 14. A drawstring 13, which may be formed of a narrower width of the material of the members 11, 12, is connected to the members 11, 12, and passes between the members 11, 12. The drawstring 13 is, in the illustrated example, a double length of material which is tied in a knot at its middle around the distal end 14 of the folded-over ribbon members 11, 12. Although in the example illustrated the ribbon is formed from two ribbon members 11, 12, and a double length of the drawstring 13 is provided, as will be appreciated, the ribbon may instead comprise only a single length of the ribbon material 11, and only a single drawstring 13 may be provided, and attached to the single ribbon member 11 at one end.

Figure 2:
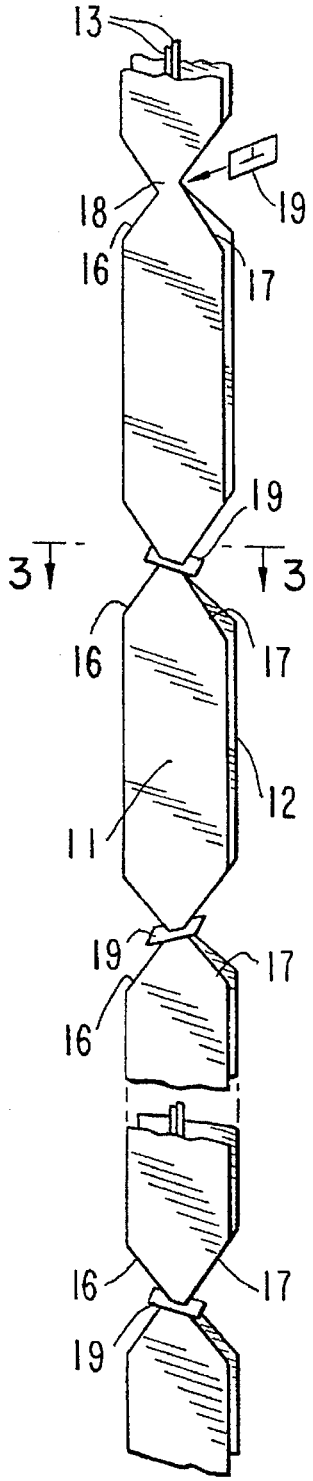
FIG. 2 is a fragmentary perspective view of the assembly of FIG. 1 on an enlarged scale, and illustrating the manufacture of the assembly.

As best shown in FIG. 2, each ribbon member 11, 12 is formed into a series of segments or bow sections, preferably of approximately uniform length, by V-shaped indentations 16, 17 cut on opposite sides of the ribbon members.

The indentations 16, 17 are offset longitudinally from each other on opposite edges of the ribbon members 11, 12 so that a narrow neck portion 18 is formed between each pair of indentations. Each neck portion 18 has its narrowest portion inclining at a small angle, e.g., about 30° to 40°, with respect to the transverse width of the ribbon members 11, 12. The successive pairs of indentations 16, 17 are formed so that each neck portion 18 inclines at an angle different from that of the preceding neck portion. As shown in the preferred embodiment of FIG. 2, the angle of inclination of each neck portion 18 is equal, but each inclines in a direction opposite to that of the preceding neck portion 18.

A retainer member or clip 19 is applied around each neck portion 18. Each clip comprises a small piece of a sheet material which is relatively stiff compared to the ribbon members 11, 12. The clip may, for example, comprise a piece of thin and stiff plastic material, e.g., a cellulose plastic material. The clip 19 is provided with a central aperture 21 of a width to receive the narrow neck portions 18 of the ribbon members 11, 12 and the drawstring members 13, the latter being received sufficiently loosely so that they can be pulled relatively freely between the neck portions 18. The clip 19 is formed with a cut 22 extending inwardly from one edge to the aperture 21. The clip 19 is applied by flexing it slightly to open the cut portion 22, so that the neck portions 18 and the drawstring members 13 can be introduced into the aperture 21.

Figure 3:
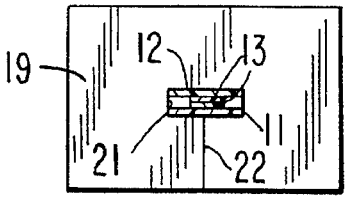
FIG. 3 is a cross-sectional view on an enlarged scale taken on the line 3—3 in FIG. 2.

As shown in FIG. 3, the neck portions 18 are received snugly in the aperture 21, so that the clip 19 is retained against movement longitudinally relatively to the ribbon members 11, 12, and adopts and maintains the orientation of the narrow neck portion 18. Each clip 19 is inclined at the same angle as the narrow neck portion 18, and is in the form of a small plate presenting planar front and rear faces extending generally perpendicularly of the plane of the ribbon members 11, 12, these faces being inclined with respect to the transverse width of the ribbon members. In the example shown, each clip 19 is inclined in a direction opposite from that of the preceding clip 19.

In order to locate the clips 19 relative to the ribbon members, and to orient them at the desired angles, it is not necessary to provide indentations of the V-shape illustrated. For example, a simple cut may be formed inwardly from each edge of the ribbon members, the cuts being offset to provide a narrow land or intervening portion around which the clip 19 may be mounted.

A decorative element 30 is attached to the assembly and, as shown in FIG. 1, at the distal end 14. Element 30 is shown as being one-dimensional and flat, but could equally well be three-dimensional. Element 30 is shown as being a card or sheet having an outline of a human head, but could equally well be a rectangular or other shaped card. Element 30 is shown as having artwork depicting a clown face, but could equally well be imprinted with any artwork or alphanumeric message. Element 30 is designed to provide a more distinctive, more stylized and customized outer appearance for the bow and, in the preferred embodiment, element 30 is a thematic character whose theme is indicative of a particular greeting, message, occasion or like event.

Element 30 can be attached to the assembly in various ways. Element 30 is advantageously formed with a hole 23 (see FIG. 6) spaced apart from an outer peripheral edge of the element. The element 30 can be attached by tying the drawstrings 13 through the hole 23, or by passing the distal end 14 of the ribbon members through the hole 23, or by passing a separate fastener, such as a tether ring 25, around the distal end 14 and through the hole 23.

Figure 4:
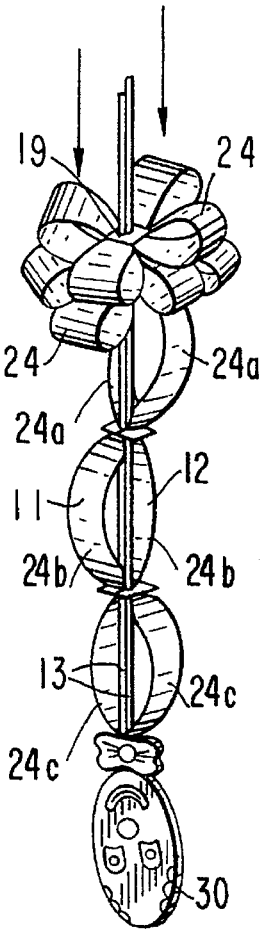
FIG. 4 is a perspective view illustrating an initial stage in the procedure of forming the bow with the assembly of FIG. 1.

In use, the ribbon in the flat form illustrated in FIGS. 1 and 2 is converted into a decorative pompom or rosette-like bow by grasping the free proximal ends of the drawstrings 13 in one hand, and by retaining a portion of the drawstrings 13 adjacent the clips 19 at the proximal ends lightly between the finger and thumb of the other hand. The drawstrings 13 are then outwardly pulled, as schematically shown in FIG. 4, 5, with the finger and thumb engaging the underside of the clip 19 so that the segments of the ribbon members 11, 12 between the indentations 16 and 17 are gathered up into loops 24. Because of the angled orientation of the clips 19, they tend to seat themselves on the bow loops, for example, the bow loops **24*a*, 24*b* and 24*c* in FIG. 4, at angularly skewed orientations. Thus, the successive loops 24*a*, 24*b* and 24*c* tend to be skewed angularly relative to one another at differing angles around the axis of the drawstrings 13 so that, instead of the loops 24 tending to superimpose themselves one on the other in a fan shape, the successive loops become arranged at differing angles spaced around the axis of the drawstrings 13 so that a bow, as depicted in FIGS. 5 and 7, is formed with the loops 24 arranged at varying angles around the axis of the drawstrings 13** to provide a desired attractive rosette or pompom-like form. It will be appreciated that FIG. 5 shows the completed bow in an inverted position relative to its normal position of use.

During bow formation, the element 30 is drawn into the center of the bow. The loops 24 around the axis and surrounding the element 30 urge the element 30 toward the center of the bow, and hold the element 30 in a desired predetermined position and orientation which, as shown in FIG. 7, is a vertically upright orientation wherein the element 30 is standing on its end. Even if the element 30 is struck, the loops 24 have sufficient resilience to bias the element 30 back to its predetermined orientation.

Once the bow is formed, the drawstrings 13 may be knotted adjacent the clip 19 exposed on the underside of the completed bow, and the free proximal ends of the drawstrings 13 may be cut off. Alternatively, the drawstrings may be used for tying a parcel, and may thus secure the completed decorative bow in position around a parcel or like gift to be decorated by the bow.

The assembly may be provided to a user with an adhesive-backed card having an aperture through which the free ends of the drawstrings are threaded. The adhesive-coated surface may normally be covered by a release paper which is removed after forming the bow in order to assist in securing the completed decorative bow to the parcel.

The bow-forming assembly may be packed flat for storage and transport. The ribbons may, for example, be folded about the narrow neck portions 18, with the segments of the ribbons being folded one on another, and with the flat decorative element 30 stacked above the folded ribbon segments, to provide a compact, folded structure.

FIG. 8 is analogous to FIG. 1, and like reference numerals have been used to identify like parts. The essential difference between the embodiments of FIGS. 1 and 8 resides in the location of the attachment of the decorative element 30. Rather than attaching the element 30 at the distal end 14, the embodiment of FIG. 8 proposes attaching the element 30 on, and in a generally parallel relationship to, one of the ribbon members, for example, ribbon member 11. The element 30 is attached to a selected one of the segments of the ribbon member 11, preferably one of the proximal segments adjacent the proximal ends of the drawstrings 13. Element 30 is attached approximately centrally of the selected segment at a spacing from the midpoint where the segment folds during formation. Element 30 has a hole 23 and, as illustrated in FIG. 9, a tether 25 extends through the hole 23 and through a corresponding hole framed through the ribbon member 11.

Upon bow formation, as shown in FIG. 10, the element 30 extends in a predetermined orientation, in this case, horizontally of the bow. Element 30 overlaps the midpoint of the segment on which it is attached, and extends horizontally beyond the periphery of the bow. Element 30 is held in this predetermined horizontal orientation by the loops 24 of the completed bow.

Figure 11:
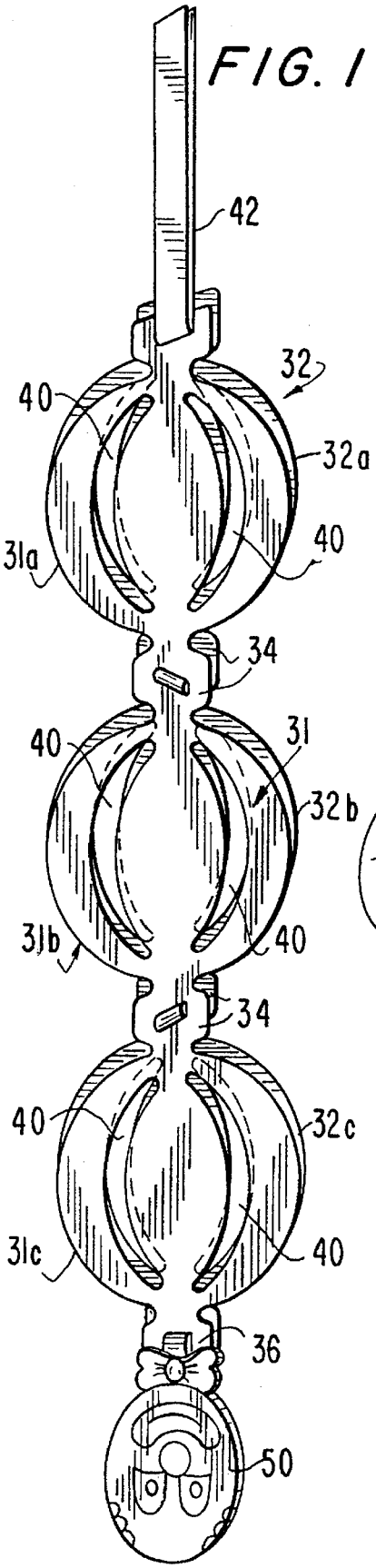
FIG. 11 is a view analogous to that of FIG. 1, but of yet another embodiment of this invention.
Figure 12:
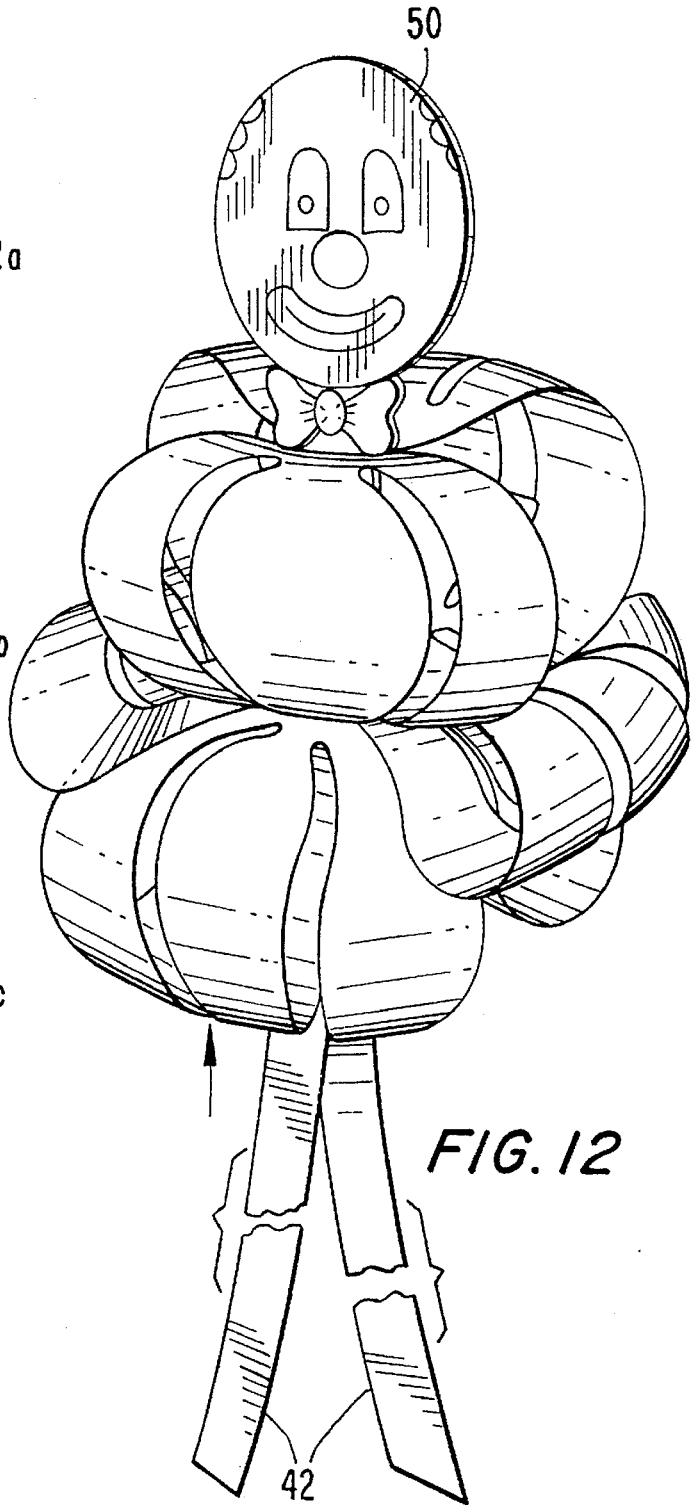
FIG. 12 is a perspective view of the completed bow of FIG. 11.

FIGS. 11 and 12 depict still another embodiment of a bow-forming assembly having a pair of elongated bow members 31, 32 of sheet-like material. Bow member 31 has a number of successively arranged, circularly-shaped bow portions 31*a*, 31*b*, 31*c*; and bow member 32 has a corresponding member of successively arranged, circularly-shaped bow portions 32*a*, 32*b*, 32*c*. Adjacent bow portions on the bow members are connected together at narrow necks or waists 34. Bow members 3 I, 32 are unitarily joined at, and foldable about, common distal end 36. Once folded, the bow members 31, 32 are in face-to-face relation.

Each bow portion is formed with a plurality of curved slits 40. Thus, the two illustrated slits 40 in bow portion 31*a* forms three bow sections, the two outer bow sections being crescent-shaped, and the inner bow section being generally elliptical in shape. All the other bow portions are similarly slitted to for multiple bow sections. A drawstring 42 has one end fixedly secured to the distal end 36, and an opposite free end serving as a handle by which one can grasp and pull the drawstring along its length. The drawstring is successively routed from the distal end 34 through an aperture in the waist 34 of a first one of the bow members, and thereupon through an aperture in the waist 34 of the other of the bow members, and so on, successively through alternate apertures in alternate bow members. The apertures are inclined at different angles of inclination in a manner completely analogous to that described above for the clips 19.

In use, one pulls on the drawstring, thereby drawing the common distal end 36 toward the waists. The bow sections fold midway between their respective ends to form loops. Due to the crescent-and elliptically-shaped nature of the bow sections, the loops are automatically angularly arranged about a central bow axis in an annulus whose center is on the axis.

A decorative element 50 is attached to the assembly at the distal end 36, preferably by being tied to said one end of the drawstring 42. Pulling of the drawstring 42 causes the decorative element 50 to be drawn toward the waists. The loops that surround the decorative element serve to hold the element 50 in a desired upright position centrally of the completed bow depicted in FIG. 12. The free end of the drawstring 42 can be cut off, if desired.

It will be understood that each of the elements described above, or two or more together, also may find a useful application in other types of constructions differing from the types described above.

While the invention has been illustrated and described as embodied in a decorative pull bow, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A decorative bow assembly, comprising:

a ribbon having a plurality of foldable bow sections;

gathering means including a drawstring for folding the bow sections into loops to form a bow; and a decorative element attached to at least one of said ribbon and said drawstring, and having generally planar opposite surface portions, said decorative element being held in a predetermined orientation by at least one of the loops engaging one of the surface portions, and by at least another of the loops engaging another of the surface portions, upon formation of the bow.

2. An assembly as claimed in claim 1, wherein the decorative element is a generally planar card on which graphics are displayed.

3. An assembly as claimed in claim 1, wherein the loops are angularly arranged about a central axis of the bow, and wherein the decorative element is held upright along the central axis.

4. An assembly as claimed in claim 1, wherein the bow sections are arranged successively along the ribbon folded to form a pair of flexible ribbon portions having a common end; and wherein the drawstring is connected to the common end; and wherein the decorative element is attached to the drawstring at the common end.

5. An assembly as claimed in claim 1, wherein the bow sections are arranged on a pair of flexible slitted sheets having a common end; and wherein the drawstring is connected to the common end; and wherein the decorative element is attached to the drawstring at the common end.

6. A bow-forming assembly, comprising:

at least one longitudinal flexible ribbon;

a plurality of segmentation means spaced along said ribbon for defining a plurality of segments of said ribbon;

at least one gathering means attached to said ribbon for gathering said ribbon to form said plurality of segments into a plurality of loops to create a bow, said gathering means being slidingly engaged with said segmentation means; and a thematic character attached to a selected said segment of said ribbon and having generally planar opposite surface portions, said character being held in a desired orientation by at least one of said loops engaging one of the surface portions, and by at least another of the loops engaging another of the surface portions, upon creation of said bow.

7. A bow-forming assembly as claimed in claim 6, wherein:

said segment to which said character is attached forms an interior loop in said bow; and other segments of said ribbon form loops adjacent to said character to hold said character in a substantially upright orientation.

8. A bow-forming assembly as claimed in claim 7, wherein:

said character is attached to a distal end of a distal segment of said ribbon;

said gathering means is attached to said distal end of said distal segment of said ribbon; and gathering of said ribbon to create said bow draws said character into the center of said bow.

9. A bow-forming assembly as claimed in claim 8, wherein said thematic character is attached to said distal end of said distal segment by tying an edge of said character to said distal end of said distal segment.

10. A bow-forming assembly as claimed in claim 6, wherein:

said segment to which said character is attached forms an exterior loop in said bow; and said character is held in a substantially horizontal orientation.

11. A bow-forming assembly as claimed in claim 10, wherein:

said character is attached to a proximal half of a proximal segment of said ribbon;

said gathering means gathers said ribbon toward said proximal segment to form said proximal segment into a peripheral loop on said bow; and gathering of said ribbon to create said bow draws said character to a lower side of said peripheral loop.

12. A bow-forming assembly as claimed in claim 11, wherein said thematic character is attached to said proximal half of said proximal segment by fastening said character parallel to said proximal half of said proximal segment.

13. A bow-forming assembly, comprising:

at least one longitudinal flexible ribbon;

a plurality of pairs of cuts spaced along said ribbon, each said pair of cuts defining one of a plurality of segments of said ribbon, each said pair of cuts including a cut on each of two opposite edges of said ribbon, each said cut of a pair being offset longitudinally relative to the other cut of said pair, each said pair of cuts being longitudinally offset at an angle opposite to the offset angle of each adjacent said pair;

a plurality of stiff retainers, each said retainer defining an aperture engaging the narrowest portion of said ribbon between said cuts of one of said pairs of cuts, each said retainer being restrained generally transversely across said ribbon at said offset angle of said pair of cuts;

at least one drawstring slidingly engaging said plurality of apertures and attached to a distal end of a distal segment of said ribbon for gathering said ribbon to form said plurality of segments into a plurality of loops to create a bow with said distal end of said distal segment in the center of said bow; and a thematic character, said character having an edge tied to said distal end of said distal segment of said ribbon to cause said character to be held in a substantially upright orientation in the center of said bow by at least one of said loops, upon gathering of said ribbon to create said bow.

14. A bow-forming assembly, comprising:

at least one longitudinal flexible ribbon;

a plurality of pairs of cuts spaced along said ribbon, each said pair of cuts defining one of a plurality of segments of said ribbon, each said pair of cuts including a cut on each of two opposite edges of said ribbon, each said cut of a pair being offset longitudinally relative to the other cut of said pair, each said pair of cuts being longitudinally offset at an angle opposite to the offset angle of each adjacent said pair;

a plurality of stiff retainers, each said retainer defining an aperture engaging the narrowest portion of said ribbon between said cuts of one of said pairs of cuts, each said retainer being restrained generally transversely across said ribbon at said offset angle of said pair of cuts;

at least one drawstring slidingly engaging said plurality of apertures and attached to a distal end of a distal segment of said ribbon for gathering said ribbon to form said plurality of segments into a plurality of loops to create a bow with a proximal segment of said ribbon forming a peripheral loop on said bow; and a thematic character attached parallel to a proximal half of said proximal segment of said ribbon to draw said character to a substantially horizontal orientation underneath said bow on a lower side of said peripheral loop, upon gathering of said ribbon to create said bow.

* * * * *